US009415585B1

(12) United States Patent
Goyen et al.

(10) Patent No.: US 9,415,585 B1
(45) Date of Patent: Aug. 16, 2016

(54) DYNAMIC POWER THRESHOLDS FOR PRINTER DEVICE PENS

(71) Applicant: HEWLETT-PACKARD DEVELOPMENT COMPANY, L.P., Houston, TX (US)

(72) Inventors: Tod Goyen, Vancouver, WA (US); Duane Koehler, Vancouver, WA (US); Matthew A. Shepherd, Vancouver, WA (US)

(73) Assignee: Hewlett-Packard Development Company, L. P., Houston, TX (US)

( * ) Notice: Subject to any disclaimer, the term of this patent is extended or adjusted under 35 U.S.C. 154(b) by 0 days.

(21) Appl. No.: 14/812,674

(22) Filed: Jul. 29, 2015

(51) Int. Cl.
*B41J 2/045* (2006.01)

(52) U.S. Cl.
CPC ..... *B41J 2/04548* (2013.01); *B41J 2/04586* (2013.01)

(58) Field of Classification Search
CPC .. B41J 2/04541; B41J 2/04543; B41J 2/0458; B41J 29/38; B41J 29/393
USPC ..... 347/5, 9, 19
See application file for complete search history.

(56) References Cited

U.S. PATENT DOCUMENTS

| | | | | |
|---|---|---|---|---|
| 5,583,547 | A * | 12/1996 | Gast | B41J 2/0457 347/22 |
| 6,183,056 | B1 | 2/2001 | Corrigan et al. | |
| 7,412,185 | B2 | 8/2008 | Hall et al. | |
| 7,695,089 | B2 | 4/2010 | Espasa et al. | |
| 8,570,564 | B2 | 10/2013 | Coffey et al. | |
| 8,840,210 | B1 | 9/2014 | Martinez de Salinas Vazquez et al. | |
| 2006/0284949 | A1 * | 12/2006 | Smith | B41J 29/393 347/102 |
| 2013/0093813 | A1 | 4/2013 | Davis et al. | |

OTHER PUBLICATIONS

"Printing Speed", < http://global.kyocera. com/prdct/printing-devices/thermal-printheads/tec/speed.html >,Feb. 1, 2001.

* cited by examiner

*Primary Examiner* — Manish S Shah
*Assistant Examiner* — Roger W Pisha, II
(74) *Attorney, Agent, or Firm* — HP Inc Patent Department

(57) ABSTRACT

An example device in accordance with an aspect of the present disclosure includes a controller to generate predicted and past power consumption values for at least one pen of a printer device, for a sliding window of future and past time, as a function of ink delivered data scaled by print speed data. The controller is to assign a dynamic power threshold for the present time as a maximum power consumption value of the sliding window, and stop power delivery to the at least one pen if the present power consumption of the at least one pen exceeds the dynamic power threshold by a margin.

13 Claims, 9 Drawing Sheets

DYNAMIC POWER THRESHOLDS FOR PRINTER DEVICE PENS

BACKGROUND

A printer can include a pen head, to receive electrical signals and cause the pen to eject ink for printing. The printer can check a temperature of the pen head before and after a print job to identify whether a pen head issue has occurred. However, during a print job, there is a risk that electrical or other failures may occur. This risk is increased for an extended print job, such as printing onto continuous feed print media, where printing may continue for hours or longer.

BRIEF DESCRIPTION OF THE DRAWINGS/FIGURES

DETAILED DESCRIPTION

Figure 1:
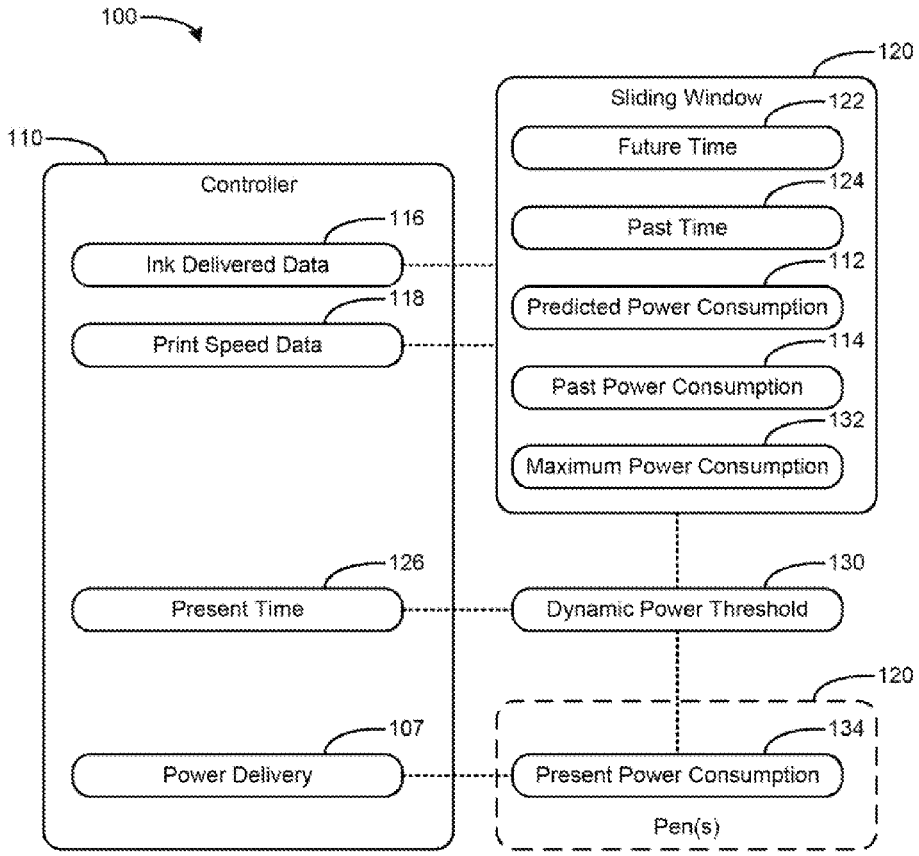
FIG. 1 is a block diagram of a device including a controller according to an example.

Inkjet print heads can be associated with relatively high current loads when printing. Issues can develop in the printer components, such as cracks in the print head die or end-cap adhesive failure. Such issues can result in conductive ink being exposed to high voltage/current, resulting in an ink short and associated rapid temperature increase and fire risk. If printing cut sheet pages, the printer has an opportunity between pages to insert a pause and perform a leak-down test on the print head, to check for voltage/current leakage through the ink path indicating a print head issue. Such testing takes time and slows down printer throughput, and is not conducive to continuous printing associated with long print jobs. A continuous print job results in the pen head being enabled continuously for relatively much longer than during a traditional cut sheet job. Thus, if an issue arises during the print job, the printer may not react in time if a leak-down test is performed after the job completes, which may result in catastrophic failure of the printer.

To address such issues, examples described herein may use a dynamic current monitor for each pen supply, to ensure that the power used does not exceed what is theoretically expected during the print job. More specifically, example printers may print extended jobs that take longer to complete than a safe check interval (e.g., a given fault condition is not allowed to draw more than 15 Watts over 2 seconds). The safe check interval is arbitrary and may change for a given printer, chosen based on empirical testing determining that it takes on the order of two seconds to ignite printer paper using a heat source (e.g., a damaged print head die drawing excessive current). Traditional discrete printing events, whether a print swath or a full page (associated with starting and stopping printing without turning off power during the discrete printing event), are typically less than two seconds due to printing necessarily pausing between cut sheets. However, with continuous feed printing, a discrete printing event may last much longer. In example page-wide array print devices, a printer swath may be as wide as a page width, and printing is accomplished by moving print media across the stationary print head. The print media may include continuous feed roll media.

Generally, example devices described herein can determine a dynamic power threshold for each set of pen(s) powered by a rail of a power supply. A sensing system of a controller can measure the power consumption in real-time, and shut down the offending pen(s) in the event of a failure, to preserve the printer system and isolate the issue. More specifically, the controller can determine the dynamic power threshold based on the ink delivered data and the current print speed. The controller position synchronizes the dynamic threshold to the print head, and measures the actual power going to the printer. If the allowed power exceeds the threshold by a margin (e.g., a margin of duration or magnitude of power etc.), the pen is powered off to ensure the system fails safe. This process is repeated for each pen power supply and/or rail.

As used herein, printer devices and printer systems include scanning inkjet printers, page-wide array printers, 3D printers, and other technology. For example, printers can include one or more printheads, such as a page-wide array printer including an array of printheads that span a print media and/or a single printhead that spans the print media. 3D printing may include the deposition of consumable fluids or other consumable materials in a layer-wise additive manufacturing process. Consumables include consumable materials used, such as inks, powders, and so on. Printing on media can include covering a layer of powder-based build material.

FIG. 1 is a block diagram of a device 100 including a controller 110 according to an example. The controller 110 is to generate values for predicted power consumption 112 and past power consumption 114, for at least one pen 120 of the printer device 100. The values are generated for a sliding window 120 of future time 122 and past time 124, as a function of ink delivered data 116 scaled by print speed data 118. The controller 110 is to assign a dynamic power threshold 130 for the present time 126, as a maximum power consumption value 132 of the sliding window 120. The controller 110 is also to identify whether present power consumption 134 of the at least one pen 120 exceeds the dynamic power threshold 130 by a margin, and if so, stop power delivery 107 to the at least one pen 120.

The sliding window 120 can identify and act on the predicted, past, and maximum power consumption values 112, 114, 132 at extremely fine scales, e.g., to a granularity of on the order of $1/50{,}000^{th}$ of an inch based on the ink delivered data 116 and the print speed data 118. Such capabilities are in stark contrast to traditional printers, which perform checks on a per-page basis between cut sheets. In an example, the sliding window 120 can represent on the order of two inches of page-wide array printing swath, to enable extremely adaptive synchronization between printer components for different timescales, to avoid diagnostic false positives. The sliding window 120 is based on time (e.g., future time 122 and past time 124), and not limited to pages. Thus, the controller 110 can monitor power at times when not printing, including idle times, to identify if printer issues arise even if a print job is not active.

The controller 110 can scale data to address changes in print speed. The data for future time 122 of the sliding window 120 can be computed for a given fixed print speed, e.g., by computing the data at one speed for a first print mode, another speed for a second print mode, and so on. The corresponding predicted power consumption 112 can remain constant for a given print job, by virtue of determining the predicted power consumption 112 as a function of ink delivered data 116 that is predetermined. For a given sliding window 120 of time, different amounts of printing can occur depending on the print speed. Accordingly, the power consumption 112, 114 for the window can be scaled for the actual print speed for any given time. For example, if printing at three inches per second (IPS), the controller may accumulate power data according to the three IPS speed. However, the print speed may increase to five IPS. Accordingly, if the sliding window 120 includes one inch of print swath back in time, the controller 110 can scale the three IPS accumulated data up to the new five IPS speed. A length of the sliding window 120 may be chosen based on providing sufficient accumulated data to address any latency of the system 100. This enables the sliding window 120 to be compatible with dynamic speed control changes by the printer while running, in contrast to being limited to a fixed static speed.

The ink delivered data 116 and print speed data 118 enable very high resolution sampling, allowing the controller 110 to mask noise that could result in false positives, enabling robust operation tolerant to print system variations and dynamics.

The dynamic power threshold 130 is not limited to a static value for a given printer, such as a global fixed safety threshold or other traditional threshold for the printer. Rather, the dynamic power threshold 130 can change for a given sliding window 120 over time, and can relate to the predicted power consumption 112 for the sliding window 120. The dynamic power threshold 130 changes based on what the controller 110 determines for the predictive model of the sliding window 120 while accounting for density of the ink delivered data 116, the print speed data 118, synchronization, and filtering out noise by oversampling when converting from the distance domain to a time domain.

The dynamic power threshold 130 can provide a maximum value associated with present power consumption 134 of the pens 120. The dynamic power threshold 130 also can provide a minimum or low threshold as well, to determine whether the power consumption is too low for a healthy print head (e.g., indicative of non-synchronization). The dynamic power threshold 130 can represent a plurality of thresholds, associated with a plurality of actions including warnings/notifications as well as powering off the pens 120. For example, the controller 110 can monitor an error term between the present power consumption 134 and the dynamic power threshold 130, and if the error term increases, the controller 110 can issue a warning. In an alternate example, the controller can count/log a number of times the present power consumption 134 exceeds the dynamic power threshold 130, and provide a warning if the number of times exceeds a value (e.g., ten times). The controller also can log the accumulated time duration that the present power consumption 134 has exceeded the dynamic power threshold 130. The controller 110 may provide an early warning notification, indicating that the pen(s) 120 are not yet at a failure condition, but have started to draw extra current, and so should be serviced soon. The controller 110 can identify margins by which the dynamic power threshold 130 is exceeded, including margins of progressive duration, number of times, or magnitude by which the dynamic power threshold 130 is exceeded. For example, the controller 110 can provide a series of warnings, including a first warning corresponding to exceeding the dynamic power threshold by a first value (e.g., 5 W), a second warning corresponding to a second value (e.g., 10 W), and so on until the controller 110 shuts down power to the pens 120 (e.g., exceeding by a margin of 20 W). Such margins can be adjust and customized for a given printer, whether a relatively low-power personal printer or high-power industrial scale printer.

Figure 2:
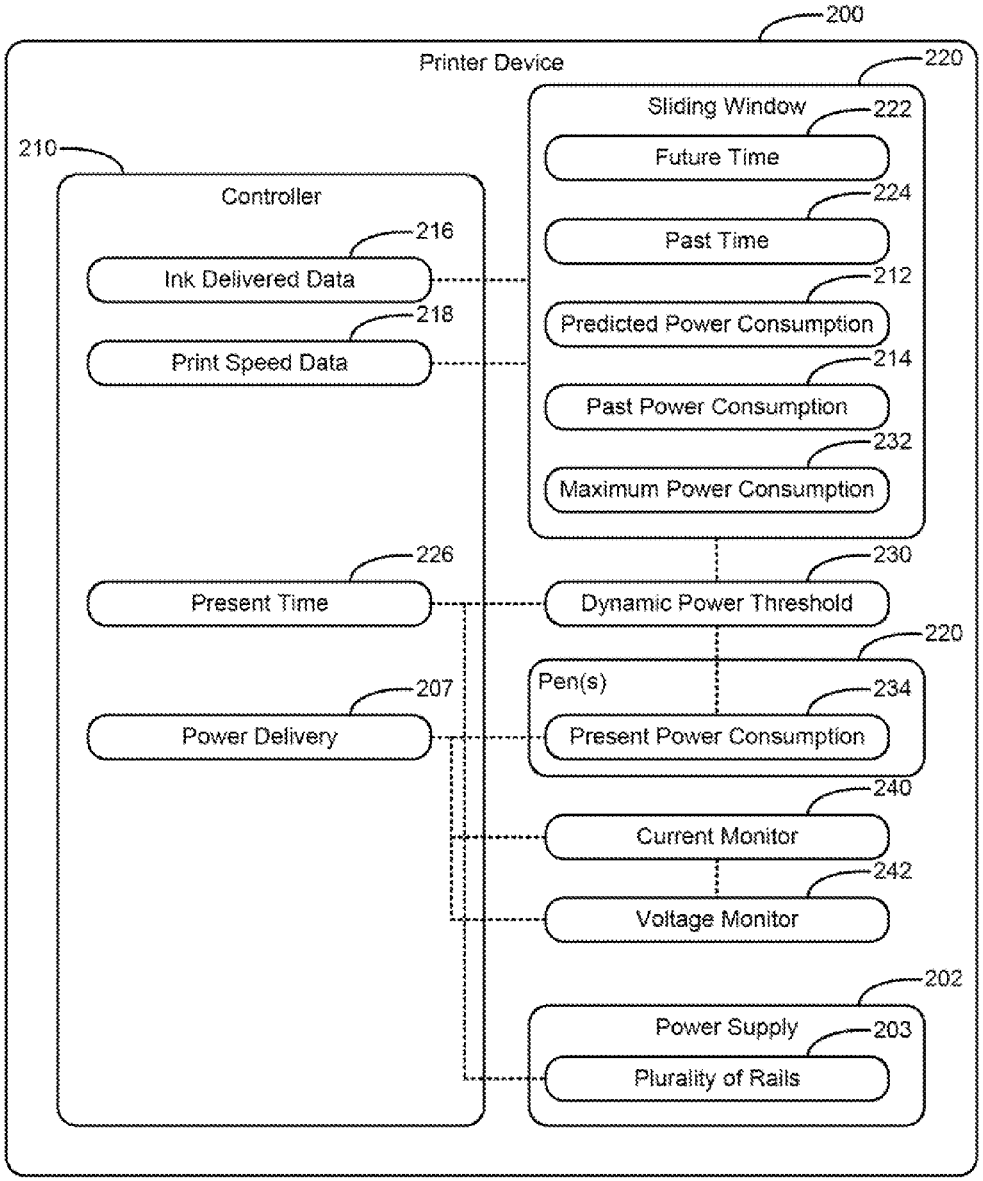
FIG. 2 is a block diagram of a printer device including a controller and a power supply according to an example.

FIG. 2 is a block diagram of a printer device 200 including a controller 210 and a power supply 202 according to an example. The printer device 200 also includes at least one pen 220 to receive power delivery 207 to print uninterrupted for a print duration exceeding a safe check interval for interrupting printing to check for printer damage. The controller 210 is to generate values for predicted power consumption 212 and past power consumption 214, for the at least one pen 220 for a sliding window 220 of future time 222 and past time 224. The controller 210 can generate the values 212, 214 as a function of ink delivered data 216 scaled by print speed data 218. The controller 210 is to assign a dynamic power threshold 230 for the present time 226 as a maximum power consumption 232 value of the sliding window 220. The controller 210 is also to identify whether present power consumption 234 of the at least one pen 220 exceeds the dynamic power threshold 230 by a margin, and if so, stop power delivery 207 to the at least one pen 220.

The power supply 202 includes a plurality of rails 203. Each rail can be independently protected by a fuse, and the rails can be isolated from each other. Thus, the printer device 200 can comply with safety standards that prohibit driving more than a given amount of energy/power delivery 207 into a fault condition (e.g., caused by a change in the present power consumption 234 of the pens 220). Because the pens 220 can collectively draw more power than a single rail fuse provides, power delivery 207 may be split among the plurality of rails 203. In an example, a rail fuse may be rated to trigger upon receiving 15 over two seconds, corresponding to a safe check interval.

The controller 210 can power off the pen(s) 220 by ceasing power delivery 207. For example, the controller 210 can disconnect a power supply circuit at a main circuit assembly, without fully shutting down the power supply 202 itself (which may continue operating and providing power to other components of the printer device 200).

The controller 210 may sense power delivery 207 based on a current monitor 240 and/or a voltage monitor 242, e.g., via an analog-to-digital converter (ADC) coupled to a sense resistor. The printer device 200 can include a precision low-resistance resistor in-line with the power delivery 207 for sensing, and the ADC can measure a voltage drop across the resistor and provide a digital signal to the controller 210.

Various components of the printer device 200 may operate similarly to the components as set forth above with respect to FIG. 1. The controller 210 can allow the dynamic power threshold 230 to be exceeded by a margin in time/duration, magnitude, and/or number of times. For example, the margin can represent one second of time, representative of how long it takes for printer paper to catch fire when heated by a print head suffering a high current/voltage fault. The margin also can by dynamically calculated to match a length of the sliding window 220 in inches, according to the print speed data 218 and chosen length of print swath the sliding window 220 represents. For example, a two-inch sliding window 220 can be associated with a margin of less than one second for a current print speed of 2 IPS.

Figure 3:
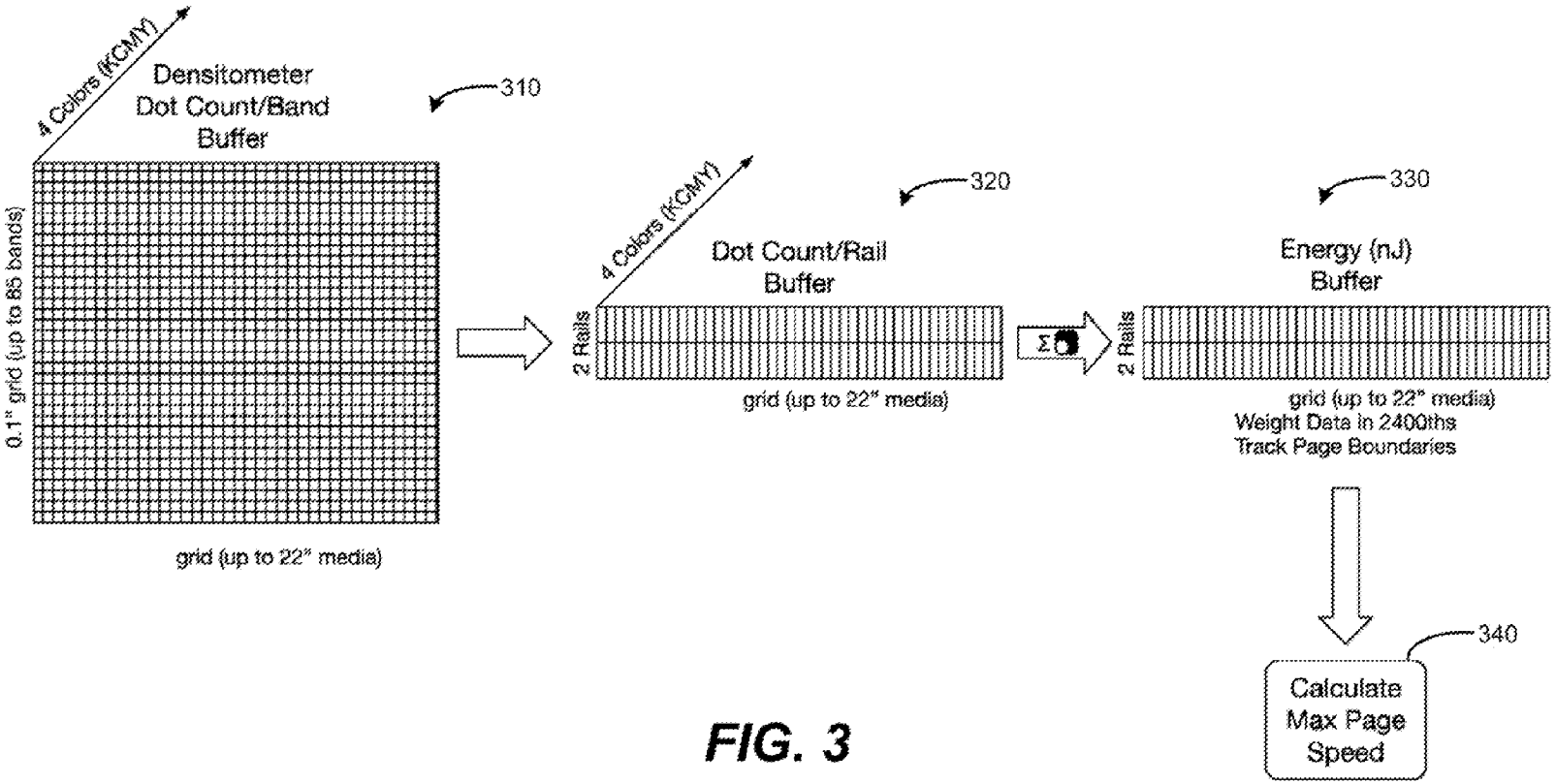
FIG. 3 is a diagram illustrating the conversion of print data to energy data according to an example.

FIG. 3 is a diagram illustrating the conversion of print data from total ink delivered data 310 to rail data 320, to energy data 330, according to an example. The examples described herein can use the energy data 330 to calculate the maximum print speed per block 340, which in turn can be used by a controller to determine a sliding window, dynamic power threshold, and so on.

A densitometer can identify ink delivered print data 310, and the controller can divide the ink delivered print data 310 into two rails of data 320. The information is shown broken up into a grid, such as grids of 0.1 inch or 0.05 (where the increment is programmable and can vary for other example grids). The print data 310 represents an image where a box is converted into 64×64 pixels, which can be varied based on a given printer's characteristics such as dots per inch (DPI). The print data 310 can be summed into the two illustrated channels of data 320, which are four channels deep in color data (black, cyan, magenta, yellow). The data 320 is multiplied by the energy per color and summed to remove the color information, to provide the energy data 330. The energy data 330 can then be used by the controller to predict power consumption and set a dynamic power threshold.

Figure 4:
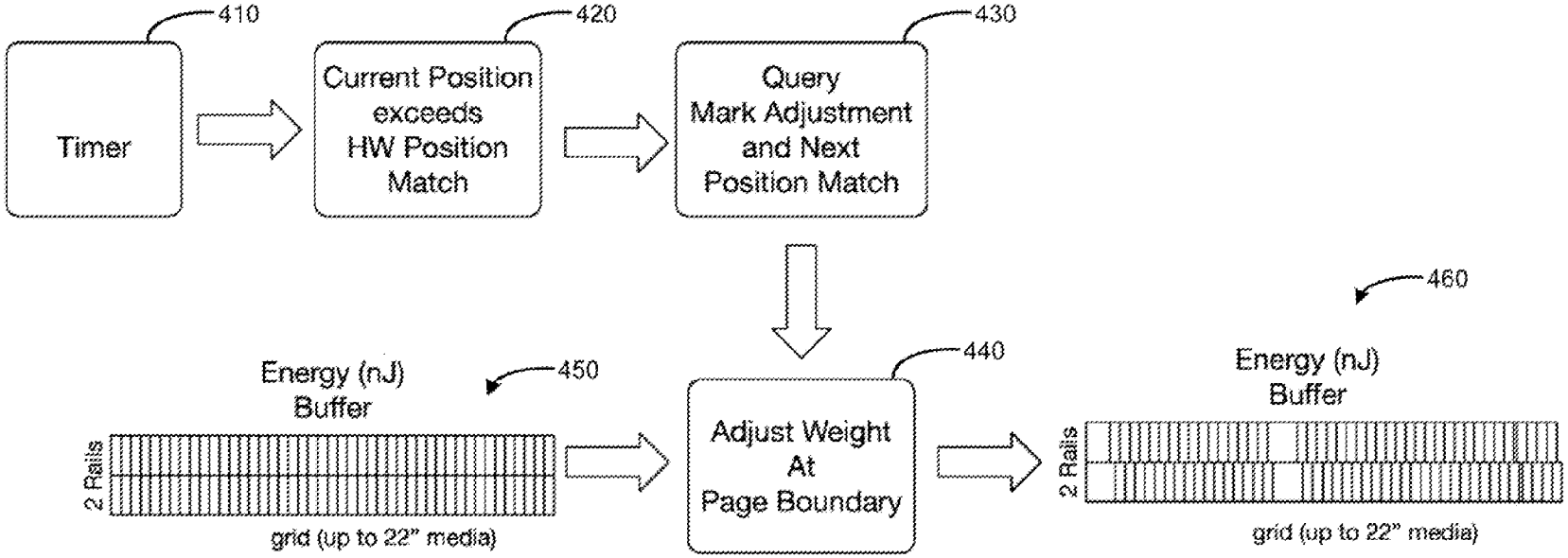
FIG. 4 is a diagram illustrating the adjustment of energy data with offsets according to an example.

FIG. 4 is a diagram illustrating the adjustment of energy data 450 with offsets according to an example. A timer 410 can be used to identify whether current position 420 exceeds a hardware position match, and a controller can query 430 whether a mark adjustment and a next position match each other. Weight 440 can then be adjusted at page boundaries, by taking the energy data 450 and inserting offsets to provide the offset energy data 460.

A printer system can thus perform energy data mark correction. Roll-fed printer media can be marked with timing marks/fiducials to enable the printer system to track the printer media movement and ensure that the ink is being printed in the right places. The controller can adjust 440 boundaries to align positions of print data/images to ensure that the densitometer data matches what is actually measured by the printer device, e.g., by inserting and removing spaces in the energy buffer data 460. This enables the controller to accurately and precisely predict power consumption for upcoming ink delivered data for a given print speed.

The data 460 is shown slightly offset between the two rails, which corresponds to a staggered offset arrangement of print heads divided between the two rails. The white gaps represent a boundary where image data is spaced farther apart, e.g., based on gaps/margins between images even if printed on continuous media.

Figure 5:
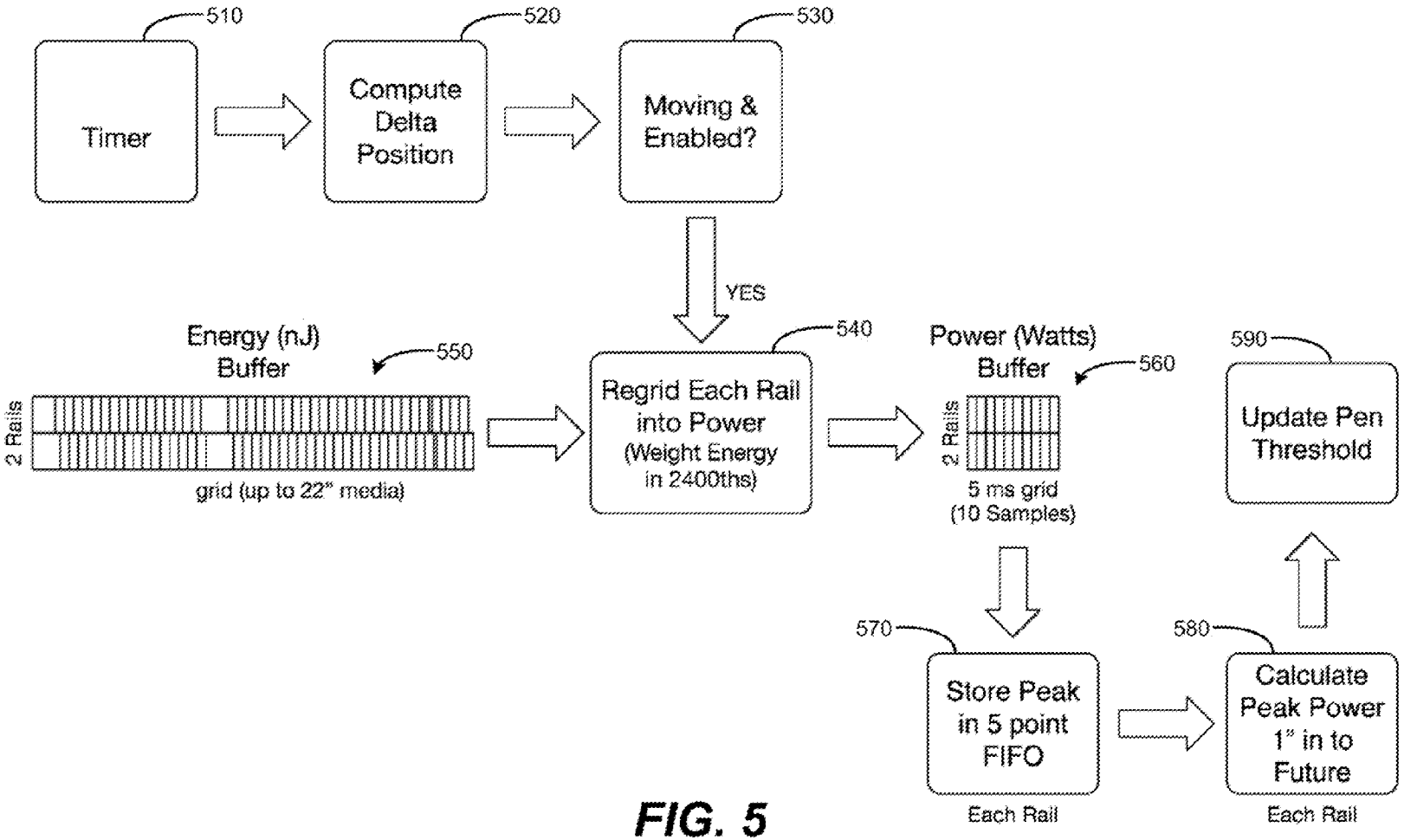
FIG. 5 is a diagram illustrating the regridding of energy data to power data according to an example.

FIG. 5 is a diagram illustrating the regridding of energy data to power data according to an example. A timer 510 is used to compute delta position 520. A check for whether the printer is moving and enabled 530 is performed, and if so, the energy data 550 is regridded 540 to power data 560. A peak of the power data 560 is stored in a memory 570, illustrated as a 5-point first in, first out (FIFO) memory. The peak power is calculated 580 into the future, and pen threshold is updated 590. The pen threshold 590 corresponds to the dynamic power threshold set forth above.

The regridding 540 can use energy per unit length from the energy data 550, and based on the printer speed, measure power as a function of energy per unit time. To avoid aliasing issues from arbitrarily multiplying by print speed, interpolation may be used by the controller to some extent to ensure that the sliding window stays the same size (with the same energy) when regridding to smooth out the results, avoiding issues from the densitometers limited resolution and potentially discontinuous increments. Thus, the regridding 540 takes some energy per unit length from the energy data 550 and converts it into power (energy per unit time) data 560, which depends on the print speed. In an example, each illustrated box in the data represents a 5 millisecond (ms) slice of the grid for every 15 ms at 20 Hertz (Hz) according to the timer 510.

A peak value of the power is stored 570 in a 5 point FIFO, based on the controller monitoring a maximum power among the grid of samples in the power data 560. The controller can consider a time into the future, and the past (as illustrated, one inch of printer swath) representing the sliding window, from which the controller can identify the dynamic power threshold 590 (e.g., a maximum value from within the sliding window).

Figure 6:
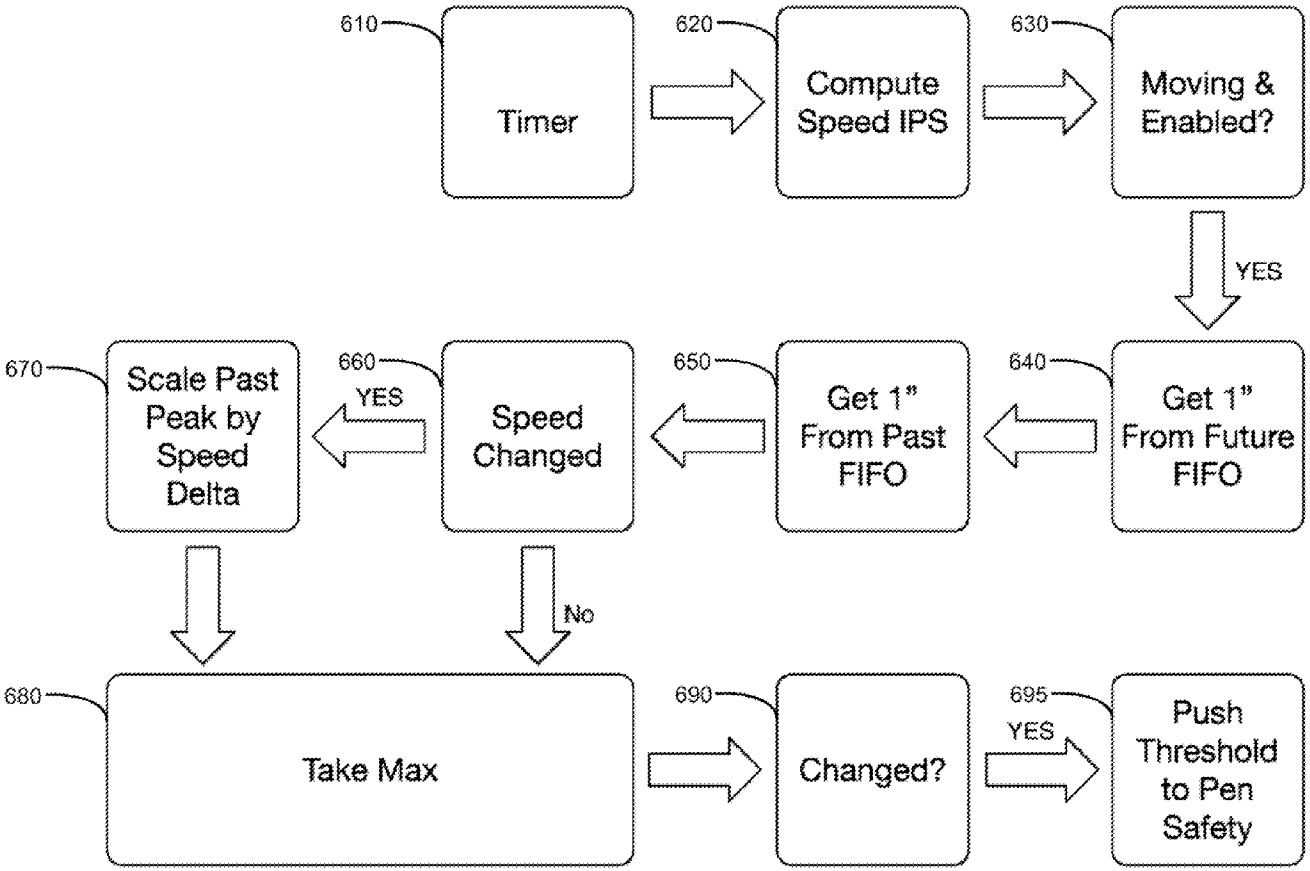
FIG. 6 is a diagram illustrating sealing for changed speed according to an example.

FIG. 6 is a diagram illustrating scaling 670 for changed speed 660 according to an example. A controller uses a timer 610 and computes 620 print speed in inches per second (IPS). The controller checks if the speed indicates the printer is moving and enabled 630. If yes, the controller obtains the equivalent of 1" of data from a future FIFO (first in, first out memory) 640, and obtains 1" from a past FIFO 650. The controller checks whether speed is changed 660. If not, the controller takes the maximum 680 threshold value from the future/past sliding window as the dynamic power threshold. If speed is changed at 660, then the controller scales 670 a previously determined (past) peak by a speed delta then takes the maximum 680 as the dynamic power threshold. If the maximum changes at 690, it is again pushed as a dynamic power threshold 695 for pen safety.

The controller can update the dynamic power threshold by scaling the predicted and past power consumption values of a sliding window by the print speed data corresponding to the time that the power consumption values were obtained. The controller can continuously/dynamically scale the dynamic power threshold to accommodate ongoing print speed changes, and select the highest value in the sliding window to set as the dynamic power threshold. Thus, the controller can monitor the pen health in real-time based on the power delivered to pen(s) on each rail (i.e., the controller can monitor power delivery on a per-rail basis).

The controller takes into account future/predicted time/data/values in order to provide various printer components some advanced indication of upcoming power consumption (e.g., based on known ink delivered data for a given print job to be printed). This enables the controller to notify components to accommodate future changes, even if a component is not updated frequently. In an example, the ink delivered data can indicate that after 20 milliseconds have passed, the print head pens will encounter a large power consumption peak corresponding to a high density of ink delivered data to be printed. Thus, the controller can predict the increased power consumption for that future point in time, and adjust the dynamic power threshold accordingly to prevent a false positive identification of a fault in the pens (if the power increase were otherwise unexpected and falsely attributed to a fault rather than the abrupt increase in print density). Such prediction, including the choice of sliding window, also allows the example devices to accommodate any latencies in the various components, ensuring that the components remain synchronized between monitoring power consumption and the sensed power consumption of the print head. The size of the sliding window may be adjusted based on the sampling rate of sensing data and obtaining ink delivered data and/or print speed data. For a faster sampling rate, the controller may reduce the sliding window, e.g., to use on the order of a few milliseconds of future data. Thus, although the examples of blocks 640 and 650 illustrated in FIG. 6 refer to one inch future and past data for the sliding window, the examples are not so limited and may be adjusted to correspond to other sizes of sliding window suitable for a given printer.

Figure 7:
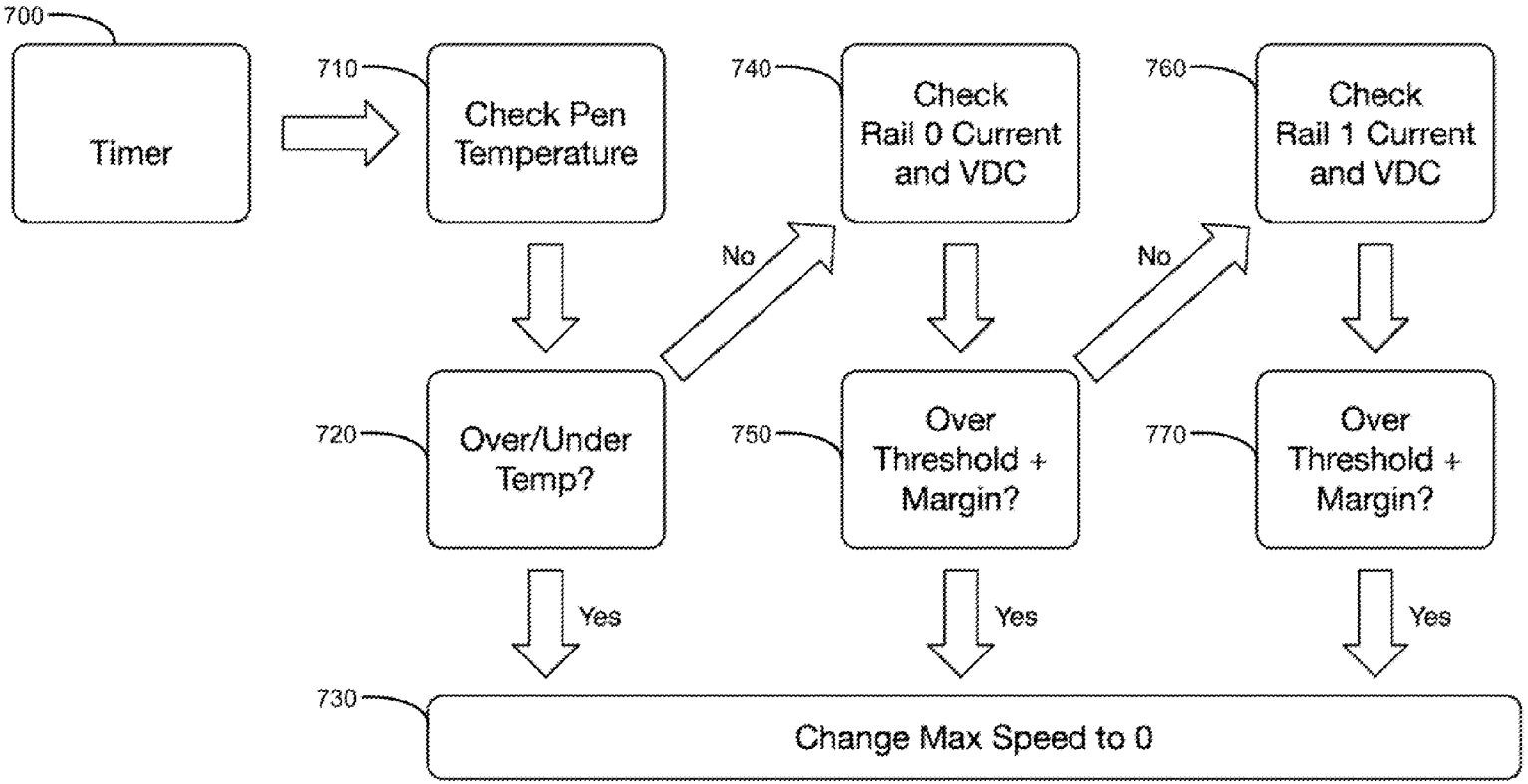
FIG. 7 is a diagram illustrating checking whether power consumption exceeds a threshold and margin according to an example.

FIG. 7 is a diagram illustrating checking 740, 760 whether power consumption exceeds a threshold and margin 750, 770 according to an example. A controller also can check for pen temperature 710, based on timer 700. If the pen temperature falls outside of an acceptable range 720, the controller can change 730 maximum speed to zero to protect the pen(s)/printer. Although not specifically mentioned in block 720, the temperature check also can be associated with a margin, similar to blocks 750 and 770. In alternate examples, the pen temperature check of blocks 710 and 720 can be omitted, enabling the controller to directly check for currents in blocks 740-770. Additionally, FIG. 7 illustrates an example approach for a system whose power supply includes two rails (rail 0 and rail 1). In alternate examples, the approach can be modified for a single rail, or for additional rails not specifically illustrated in FIG. 7, by adding or removing blocks correspondingly. The controller can check 740 current and/or voltage for a first rail, and determine 750 whether the current and/or voltage exceed the threshold by a margin. If so, the controller can change 730 maximum speed to zero, to protect the pen(s)/printer. If not over the threshold and margin at block 750, the controller can similarly check the next rail(s), e.g., via blocks 760 and 770.

The checks illustrated in FIG. 7 can be used by a controller to ensure pen safety. Checks for two rails are illustrated, and a rail may be associated with different current/voltage values compared to other rail(s). The controller can refer to timer 700 to identify when to perform the various checks. In an example, the controller performs the series of checks 710, 740, 760 every 100 ms. The checks can be performed by comparing the sensed values (blocks 710, 740, 760) to the target values as determined by the controller (blocks 720, 750, 770). If the controller identifies that a sensed value differs from the desired values as determined by the controller, the controller can check if the difference exceeds the margin. For example, for a margin of duration, the controller can start a timer to identify how long the value exceeds the dynamic power threshold, and act when the duration reaches a determined amount (e.g., two seconds). As described above, the dynamic power thresholds (checked for at blocks 750, 770) can be obtained by identifying a maximal peak in a sliding window scaled for the present print speed.

The checks shown in FIG. 7 enable the controller to apply the dynamic power thresholds and address potential safety hazards caused by issues with print head pens drawing excessive power and/or temperature. For example, the print heads for a given printer may usually draw 10 W, but the checks 750, 770 can identify that the print heads are drawing 50 W. This exceeds a 10 W dynamic power threshold and a 5 W margin by a substantial amount, indicating that the energy usage is anomalous and likely creating a safety hazard so the print head pens should be shut down and/or the printer speed should be set to zero. Although block 730 indicates the max speed is set to zero, block 730 can also take other actions, such as shutting off power to the printer pens and/or the entire printer.

Figure 8:
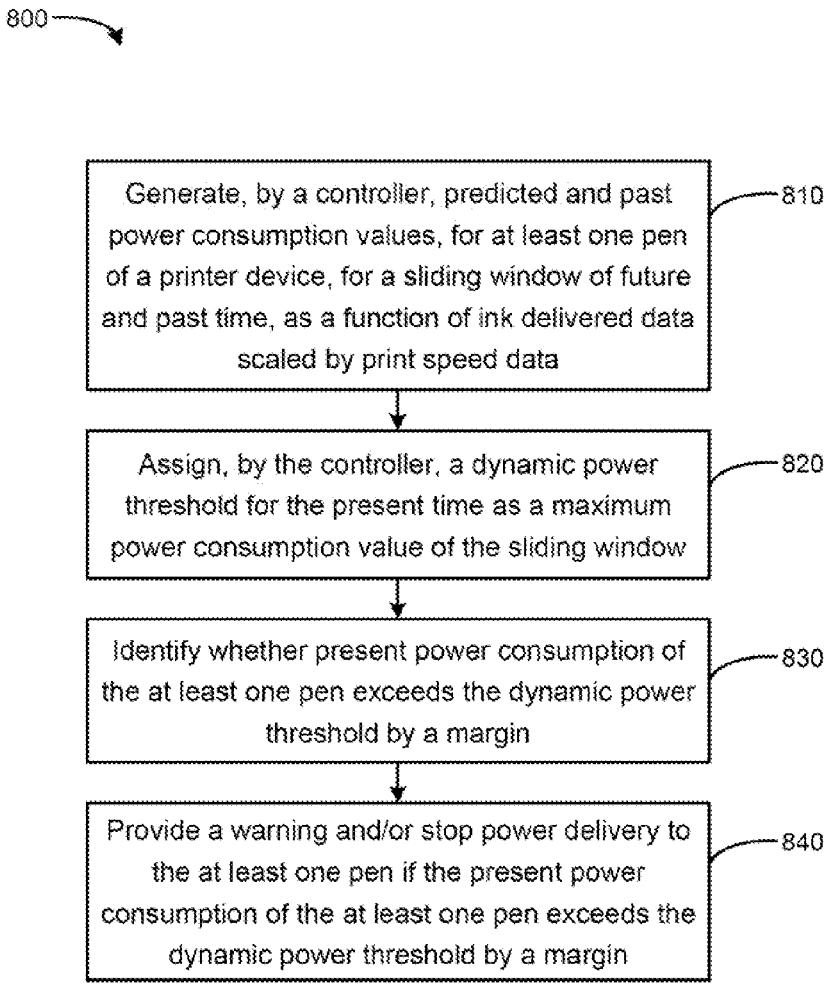
FIG. 8 is a flow chart based on providing a warning and/or stopping power delivery to the pen(s) according to an example.
Figure 9:
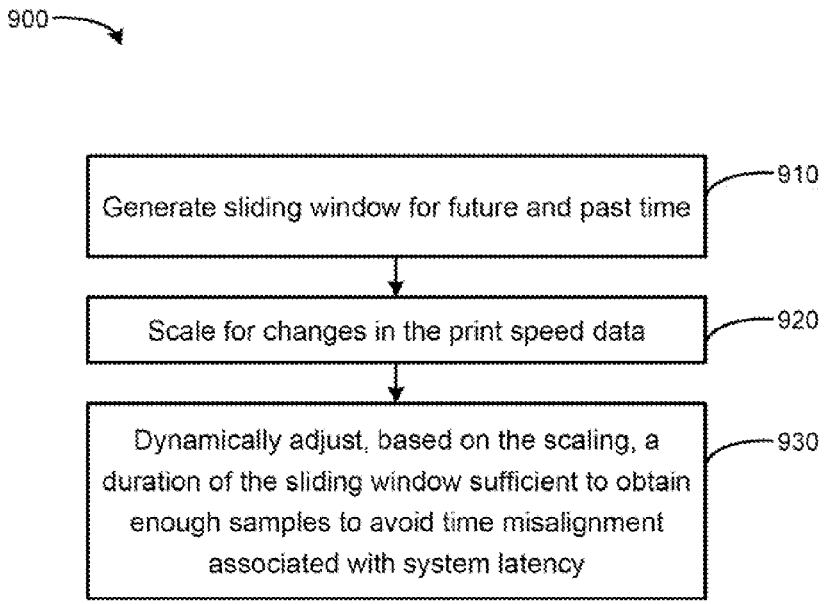
FIG. 9 is a flow chart based on dynamically adjusting a sliding window according to an example.

Referring to FIGS. 8 and 9, flow diagrams are illustrated in accordance with various examples of the present disclosure. The flow diagrams represent processes that may be utilized in conjunction with various systems and devices as discussed with reference to the preceding figures. While illustrated in a particular order, the disclosure is not intended to be so limited. Rather, it is expressly contemplated that various processes may occur in different orders and/or simultaneously with other processes than those illustrated.

FIG. 8 is a flow chart 800 based on providing a warning and/or stopping power delivery to the pen(s) according to an example. In block 810, a controller is to generate predicted and past power consumption values, for at least one pen of a printer device, for a sliding window of future and past time, as a function of ink delivered data scaled by print speed data. For example, the controller can establish a two-inch sliding window to examine ink delivered data and determine what the power consumption has been and will be for that sliding window, to establish what is expected in terms of acceptable power consumption by the print head pens. The data can be scaled for the sliding window, based on changes in print speed, to ensure the system remains synchronized and avoids false positives for fault identifications. In block 820, the controller is to assign a dynamic power threshold for the present time as a maximum power consumption value of the sliding window. For example, the controller can examine the past and predicted power consumption values within the window, scaled for print speed, and identify a maximum value among them that is then used to set the dynamic power threshold. In block 830, the controller is to identify whether present power consumption of the at least one pen exceeds the dynamic power threshold by a margin. For example, the power consumption can exceed the threshold by a margin of time duration (e.g., for two seconds), magnitude (e.g., by five watts), or accumulated number (e.g., exceed the threshold for ten instances). In block 840, the controller is to provide a warning and/or stop power delivery to the at least one pen if the present power consumption of the at least one pen exceeds the dynamic power threshold by a margin. For example, the controller can provide a series of escalating warnings based on the degree of exceeding the margin, such as warning that the printer is approaching a need for servicing, that the printer needs a print head replacement, and that the printer has been shut down due to failure of the print head.

FIG. 9 is a flow chart 900 based on dynamically adjusting a sliding window according to an example. In block 910, a controller is to generate a sliding window for future and past time. For example, the controller generates power consumption values for a sliding window extending into the future and the past. In block 920, the controller is to scale for changes in the print speed data. For example, as print speed changes, the controller can adjust the sliding window to remain the same duration despite the speed changes. In block 930, the controller is to dynamically adjust, based on the scaling, a duration of the sliding window sufficient to obtain enough samples to avoid time misalignment associated with system latency. For example, a mismatch between sensed data and predicted data may result if the number of samples is insufficient to extend the sliding window to cover a duration that spans a latency of the various system components. Accordingly, the controller can widen the sliding window to encompass enough samples, and/or increase the sample rate to generate enough samples, to provide enough data to avoid latency issues.

Examples provided herein may be implemented in hardware, software, or a combination of both. Example systems can include a processor and memory resources for executing instructions stored in a tangible non-transitory medium (e.g., volatile memory, non-volatile memory, and/or computer readable media). Non-transitory computer-readable medium can be tangible and have computer-readable instructions stored thereon that are executable by a processor to implement examples according to the present disclosure.

An example system (e.g., including a controller of a printing device) can include and/or receive a tangible non-transitory computer-readable medium storing a set of computer-readable instructions (e.g., software, firmware, etc.) to execute the methods described above and below in the claims. For example, a system can execute instructions to direct a window generating engine to generate the sliding window, and a power engine to assign the dynamic power threshold, wherein the engines include any combination of hardware and/or software to execute the instructions described herein. As used herein, the processor can include one or a plurality of processors such as in a parallel processing system. The memory can include memory addressable by the processor for execution of computer readable instructions. The computer readable medium can include volatile and/or non-volatile memory such as a random access memory ("RAM"), magnetic memory such as a hard disk, floppy disk, and/or tape memory, a solid state drive ("SSD"), flash memory, phase change memory, and so on.

What is claimed is:

1. A device comprising:

a controller to generate predicted and past power consumption values, for at least one pen of a printer device, for a sliding window of future and past time, as a function of ink delivered data scaled by print speed data, wherein the controller is to position synchronize the dynamic power threshold to the at least one pen, based on offsetting the ink delivered data and print speed data corresponding to a position offset of the at least one pen relative to the printer device;

wherein the controller is to assign a dynamic power threshold for the present time as a maximum power consumption value of the sliding window, identify whether present power consumption of the at least one pen exceeds the dynamic power threshold by a margin, and if so, stop power delivery to the at least one pen.

2. The device of claim 1, wherein the controller is to scale for changes in the print speed data to dynamically adjust the sliding window to avoid time misalignment associated with system latency.

3. The device of claim 1, wherein the margin corresponds to a time period during which the present power consumption can exceed the dynamic power threshold.

4. The device of claim 3, wherein the controller is to identify accumulated time that the present power consumption exceeds the dynamic power threshold, and issue a warning regarding printer health corresponding to the accumulated time.

5. The device of claim 1, wherein the margin corresponds to a power value within which the present power consumption can exceed the dynamic power threshold.

6. The device of claim 5, wherein the controller is to identify by how much the present power consumption exceeds the dynamic power threshold, and issue at least one warning from among a series of escalating warnings regarding printer health corresponding to by how much the present power consumption exceeds the dynamic power threshold.

7. The device of claim 1, wherein the sliding window of future and past time is to include a duration of non-printing time, such that the controller is to generate the predicted and past power consumption values regardless of whether the at least one pen is printing during the sliding window.

8. A printer device comprising:

at least one pen to receive power to print uninterrupted for a print duration exceeding a safe check interval for interrupting printing to check for printer damage; and a controller to generate predicted and past power consumption values, for the at least one pen for a sliding window of future and past time, as a function of ink delivered data scaled by print speed data, wherein the controller is to obtain the ink delivered, data by filtering out noise from dot count information based on oversampling;

wherein the controller is to assign a dynamic power threshold for the present time as a maximum power consumption value of the sliding window, identify whether present power consumption of the at least one pen exceeds the dynamic power threshold by a margin, and if so, stop power delivery to the at least one pen.

9. The printer device of claim 8, wherein the print duration corresponds to uninterrupted sweep along a page-wide printing swath of the printer device for printing on continuous print media lacking interruptions to check for printer damage between single cut sheets during the safe check interval for the printer device.

10. The printer device of claim 8, further comprising a current monitor and voltage monitor to enable the controller to sense the present power consumption.

11. The printer device of claim 8, further comprising a power supply including a plurality of rails to deliver power, wherein the at least one pen is to receive power via a rail of the power supply, and wherein the controller is to identify a plurality of dynamic power thresholds corresponding respectively to a plurality of rails and associated plurality of pens.

12. A method, comprising:

generating, by a controller, predicted and past power consumption values, for at least one pen of a printer device, for a sliding window of future and past time, as a function of ink delivered data scaled by print speed data, wherein the controller is to obtain the ink delivered data by filtering out noise from dot count information based on oversampling;

assigning, by the controller, a dynamic power threshold for the present time as a maximum power consumption value of the sliding window;

identifying whether present power consumption of the at least one pen exceeds the dynamic power threshold by a margin; and at least one of providing a warning and stopping power delivery to the at least one pen if the present power consumption of the at least one pen exceeds the dynamic power threshold by a margin.

13. The method of claim 12, further comprising scaling for changes in the print speed data; and dynamically adjusting, based on the scaling, a duration of the sliding window sufficient to obtain enough samples to avoid time misalignment associated with system latency.

* * * * *